US006513842B1

(12) United States Patent
Fuehrer

(10) Patent No.: US 6,513,842 B1
(45) Date of Patent: Feb. 4, 2003

(54) TAMPER INDICATING SEAL FOR SHIPPING CONTAINERS

(75) Inventor: Charles Fuehrer, Scarsdale, NY (US)

(73) Assignee: Stoffel Seals Corporation, Nyack, NY (US)

( * ) Notice: Subject to any disclaimer, the term of this patent is extended or adjusted under 35 U.S.C. 154(b) by 0 days.

(21) Appl. No.: 09/906,803

(22) Filed: Jul. 18, 2001

(51) Int. Cl.[7] ..... B65D 33/34
(52) U.S. Cl. ..... 292/307 R; 292/323; 292/325
(58) Field of Search ..... 292/307 R, 327, 292/307 B, 323, 325, 282, 284, 286

(56) References Cited

U.S. PATENT DOCUMENTS

| | | | | | |
|---|---|---|---|---|---|
| 950,151 | A | | 2/1910 | Fox | |
| 960,271 | A | * | 6/1910 | Campbell | 292/307 R |
| 1,081,978 | A | | 12/1913 | Mitchell | |
| 1,516,787 | A | * | 11/1924 | Railsback | 292/282 |
| 1,987,351 | A | * | 1/1935 | Rose | 292/328 |
| 2,104,204 | A | * | 1/1938 | Martinez | 292/307 |
| 2,113,306 | A | * | 4/1938 | Martinez | 247/2 |
| 2,368,613 | A | | 2/1945 | Perrotta | |
| 2,661,558 | A | | 12/1953 | Salisbury | |
| 3,146,009 | A | * | 8/1964 | Adler | 292/115 |
| 3,172,692 | A | | 3/1965 | Brooks | |
| 4,010,788 | A | * | 3/1977 | Gompel | 151/2 A |
| 4,500,124 | A | * | 2/1985 | Swift | 292/318 |
| 4,676,535 | A | | 6/1987 | Mautner | |
| 4,747,504 | A | | 5/1988 | Wiseman et al. | |
| 4,834,434 | A | * | 5/1989 | Moore | 292/253 |
| 4,902,055 | A | | 2/1990 | Scott et al. | |
| 5,568,952 | A | * | 10/1996 | Ruegg | 292/318 |
| 6,174,006 | B1 | | 1/2001 | Burt | |

* cited by examiner

*Primary Examiner*—Gary Estremsky
(74) *Attorney, Agent, or Firm*—Dowell & Dowell, P.C.

(57) ABSTRACT

A tamper indicating seal for doors or panels such as used on airborne shipping containers. The seal includes a housing mounted over an edge of a container door and having an opening for receiving a strap of an elongated shackle having a base portion engageable with a frame or other portion of the container. A locking cage is disposed within the opening and interlocks with the strap as the strap is pulled outwardly of the opening to thereby secure the housing to the container such that any attempt to open the door will cause a visual failure of the housing.

13 Claims, 4 Drawing Sheets

Fig. 9
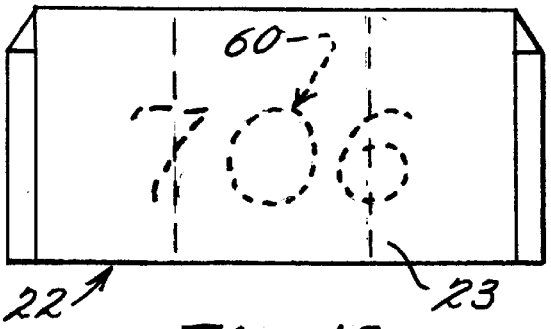
Fig. 11
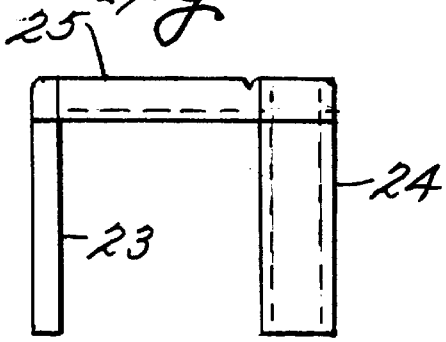
Fig. 10
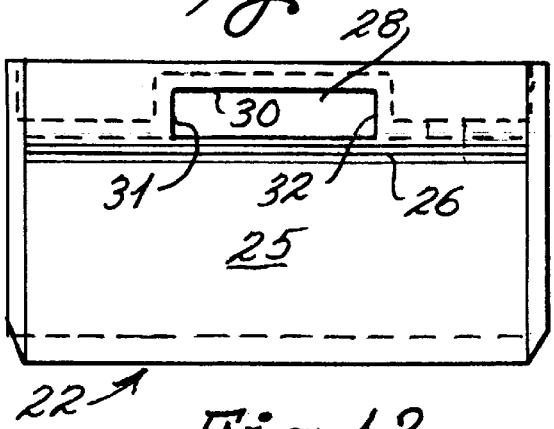
Fig. 13
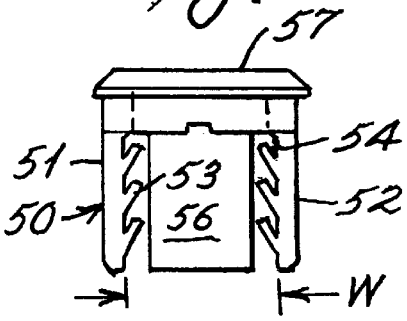
Fig. 12
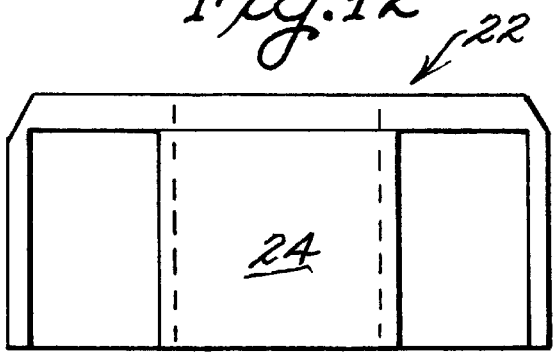
Fig. 14
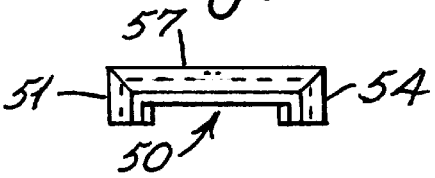
Fig. 15
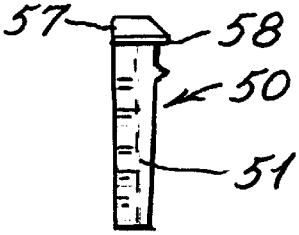
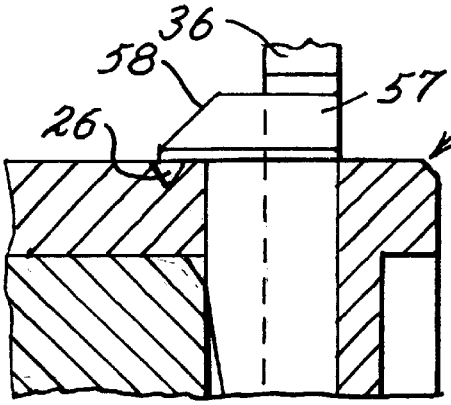
Fig. 3a

TAMPER INDICATING SEAL FOR SHIPPING CONTAINERS

BACKGROUND OF THE INVENTION

1. Field of the Invention

The present invention is directed to tamper indicating seals of the type which are utilized to provide a visual indication of tampering if access is attempted to a container on which the seals are placed and more particularly to such seals which are adapted to be used with containers having doors or other closure panels for sealing openings therein after articles are placed within the containers.

2. Brief Description of the Related Art

Security seals are utilized in many different environments to discourage theft or tampering and/or provide visual indication of tampering with respect to unauthorized access to containers, vehicles, storage areas, secured rooms, meters, valves as well as other items which are subject to tampering. Many such seals are known in the art as shackle seals. Shackle seals includes elongated straps which are insertable through an open housing after the straps have been wrapped around a portion of an object to prevent the portion of the object from being displaced or moved without breaking the seals. By way of an example, a pivotable latch handle for a door of a delivery vehicle may have a shackle-type seal placed around the handle and through a fixed object adjacent to the handle with the strap of the seal being inserted through a lock housing of the seal in such a manner that the strap is locked within the housing in a closed encircling relationship with respect to handle and the fixed object. In this manner, the opening of the door is prevented unless the seal is tampered with. However, if the seal is tampered with to obtain access to the cargo area, it is designed to fracture or break. In this manner a visual indication is provided by the destruction of the seal that someone has gained or attempted to gain, unauthorized access to the cargo area of the vehicle.

To prevent tampering with such shackle-type seals by prying the straps free of the lock housings associated therewith, such seals include weakened portions, such that if any attempt is made to bypass the interlocking relationship between the seal straps and the lock housings, the seals will fracture or otherwise break, thereby giving a visual indication that they have been tampered with and also preventing the reassembly of the seals by individuals who may have tampered with the seals to gain access to a controlled or restricted area.

Such shackle-type seals are effective when they can be placed in encircling relationship about or through an object to prevent its unauthorized movement. However, there are many instances where shipping and other types of containers are not provided with closures which are constructed in a manner which is suitable for use with encircling security seals. By way of example, some shipping containers, including some airborne shipping containers, include doors or closure panels which can be opened in different manners, such as by pivoting up or out relative to the containers in such a way that conventional shackle seals cannot be used. There is thus a need to provide seals to give a visual indication of tampering and to discourage tampering with such containers.

SUMMARY OF THE INVENTION

The present invention is directed to a tamper indicating seal which is specifically designed for use with airborne shipping containers and other enclosures which have doors or closure panels which can be opened by pivoting or moving in one or a plurality of motions relative to openings in the containers. The tamper indicating seals include three basic components including a housing adapted to be mounted on an edge of a container door. The housing has an opening therein and a weakened area adjacent the opening which will fracture if the seal is tampered with. The seal also includes a shackle having an elongated strap which extends outwardly through the opening in the housing and a base which is designed to be inserted within the container so as to be engageable about a frame or other member of the container such that the shackle cannot be pulled from the container when a force is applied to pull the strap outwardly through the opening in the housing. A third component of the seal includes a locking cage having a plurality of teeth which interlock with teeth provided along a portion of the strap. The cage is received within the opening of the housing such that when the shackle has been placed with its base anchored to the interior frame or other member of the container and the strap extended through the locking cage in the opening of the housing, the shackle can be pulled outwardly relative to the container when the door or closure panel is closed, to thereby secure the strap to the housing and preventing opening of the door until the seal is broken. The locking teeth of the cage and shackle strap are structured to permit the strap to be pulled outwardly relative to the container but prevent the strap from being forced in an opposite direction in an attempt to disengage the shackle base from the frame of the container.

In the preferred embodiment, the cage is formed in a generally U-shaped cross section having three leg portions, two of which oppose one another. The opposing leg portions include teeth for interlocking with the teeth extending outwardly from side edges of the elongated strap. The angle of the teeth of the cage member and of the elongated strap are such as to prevent any withdrawal of the strap relative to the cage once the strap has been pulled tight after the door is closed.

Also, in a preferred embodiment, the housing has a generally inverted U-shaped configuration having an outer flange for engaging an outer face of the container door or closure panel, a central portion for seating against an edge of the container door, and an inner portion extending adjacent an inner face of the door. A recessed channel is formed adjacent to the opening in the housing of a size to slidingly receive the strap member and cage therein.

The base portion of the strap member may include a first V-shape trough portion for securely receiving a bottom edge of a frame of the container door and an outwardly extending generally horizontal flange also for use in engaging a flat frame surface of a door or other closure of a container. Further, the base includes an outer flared flange which extends inwardly of the container frame such that manipulation of the base of the seal relative to the frame of the container in an attempt to remove the strap once the door is closed is not possible.

In the preferred embodiment, the locking cage includes an upper flange which is engageable with the central portion of the housing when the cage is fully inserted within the opening therein, thus limiting the degree of vertical movement of the cage with respect to the housing.

In each of the embodiments, identification numbers, letters or other indicia may be applied to the outer flange or other portion of the housing to specifically identify the seal for tracking purposes and inventory control.

It is the primary object of the invention to provide a security seal which may be utilized with various type of containers wherein one component of the seal engages an interior member of the container, another component engages a movable closure or door and a third component locks the other components together such that any attempt to open the closure relative to the container will result in the destruction of the seal thus giving a visual indication of tampering.

It is a further object of the present invention to provide security seals particularly adapted for use with various airborne shipping containers wherein the seals are made of plastic components which can be made in an economical manner and which can be used to discourage tampering with such containers and wherein any attempt to bypass the seals will result in a rupturing of the seals to thereby give visual indications of tampering.

A BRIEF DESCRIPTION OF THE DRAWINGS

A better understanding of the invention will be had with respect to the drawing figures wherein:

FIG. 3A is an enlarged partial cross sectional view similar to that taken along line 3—3 of FIG. 1 showing a line of weakness provided in the upper portion of the housing of the seal of the invention;

FIG. 9 is a front elevational view of a seal housing of the invention;

FIG. 10 is a top plan view of the seal housing of the invention;

FIG. 11 is a side view of the housing of the invention;

FIG. 12 is a rear elevational view of the housing of the invention;

FIG. 13 is a front elevational view of a locking cage of the invention;

FIG. 14 is a top plan view of the locking cage of the invention;

FIG. 15 is a side view of the locking cage of the invention.

DESCRIPTION OF THE PREFERRED EMBODIMENT

The tamper indicating seal 20 of the present invention is specifically designed to be used with containers "C" having doors or closure panels "D". The containers may be of various configurations and be within the teachings of the present invention. However, the seal 20 is particularly adapted for use in securing containers of the type used by courier services for air freight shipping. Such a container is disclosed in U.S. Pat. No. 4,747,504 to Wiseman et al., the contents of which are incorporated herein by reference.

As disclosed in the Wisemen et al., patent an airborne shipping container is configured to be cooperatively received within a cargo area of an aircraft and includes a door which is movable relative to a frame defining an opening into the container. In some airborne shipping containers the door may be opened in more than one direction relative to the container. In the Wiseman et al. patent, the door is formed in plural hinged sections. An upper section may be opened by pivoting outwardly and downwardly relative to lower sections to thereby partially open the access opening into the container while the lower sections remain closed. To fully open the door, the sections or panels of the door are raised vertically and pivoted to an overlapping arrangement on top of the container.

Figure 2:
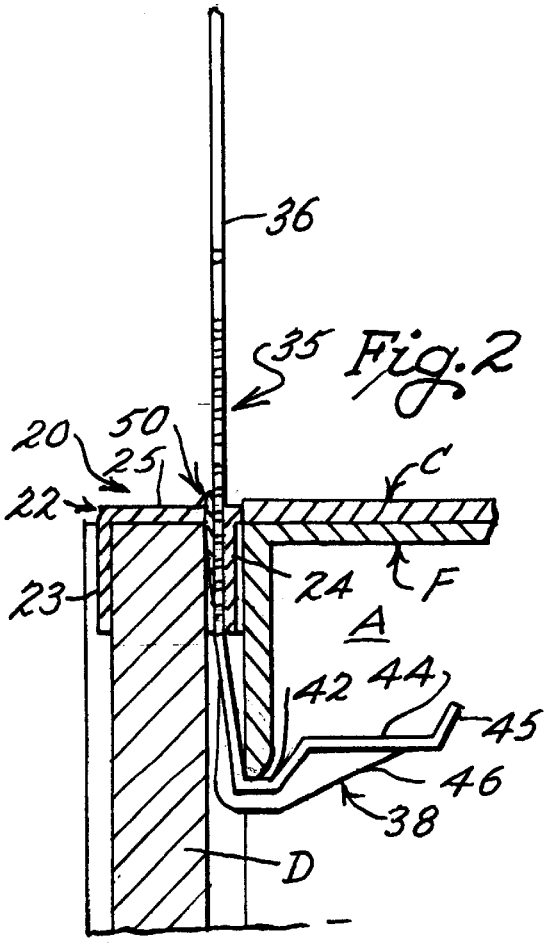
FIG. 2 is a cross sectional assembly view taken along line 2—2 of FIG. 1 showing the seal being placed between a container and a closure of the container.
Figure 5:
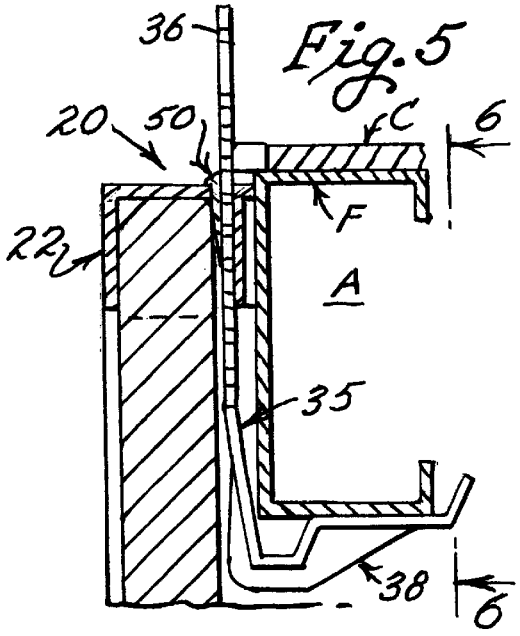
FIG. 5 is a view similar to FIG. 2 showing a different structure of internal frame for a container having its door secured using the seal of the invention.
Figure 6:
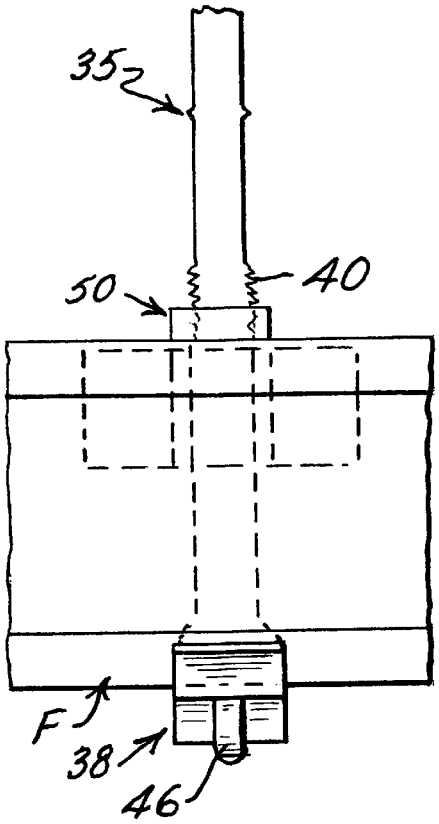
FIG. 6 is a view taken along line 6—6 of FIG. 5.

To provide a visual indication of unauthorized movement of a door such as described above and disclosed in the Wiseman et al. patent, a seal must be structured to obstruct movement of the door in a plurality of directions. Referring to FIGS. 2 and 5 of the drawings, the container defines an interior storage area "A" which is normally reinforced by a frame "F" which extends around an opening into the container. The seal for the container is secured to both the container frame and the door so that any movement of the door will cause the seal to break and thus provide a visual indication of tampering.

The tamper indicating seal 20 includes a generally inverted U-shaped housing 22 which is adapted to engage over an edge of the door "D" of the container "C". In the drawings the housing is placed over an upper edge of the door, however, it may be placed on other edges if desired. The details of the housing are shown in FIGS. 9–12. The housing includes an outer flange 23 and an inner flange 24 which are connected by a central portion 25. A line of weakness or score 26 is provided across the upper portion 25 for purposes which will be discussed in greater detail. As shown in the top plan view of FIG. 10, an opening 28 is provided in the housing through the upper portion 25 and extending between parallel segments of the flange 24 such that the flange 24 is define having an internal recess defined by an inner wall 30 and side walls 31 and 32. The distance between the flanges 23 and 24 is such as to allow the door "D" of the container to be cooperatively seated therein such that the inner flange 24 is adjacent to the inner surface of the door "D".

Figure 7:
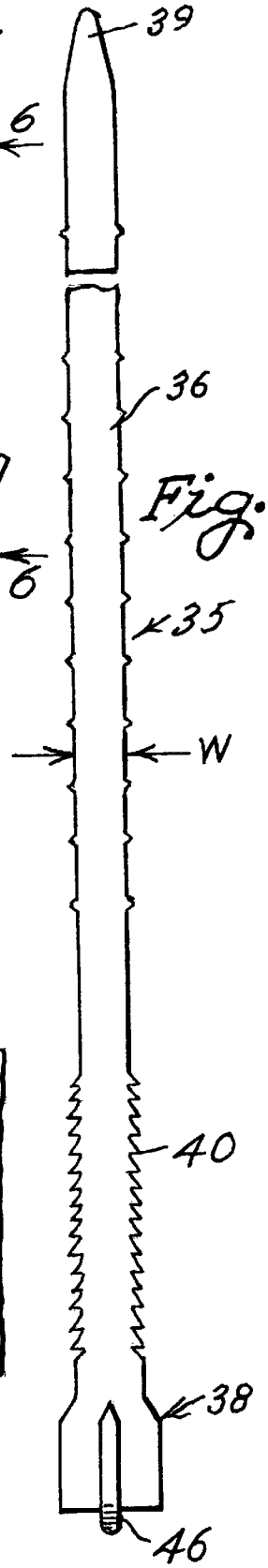
FIG. 7 is a front elevational view of the shackle of the seal of the invention.
Figure 8:
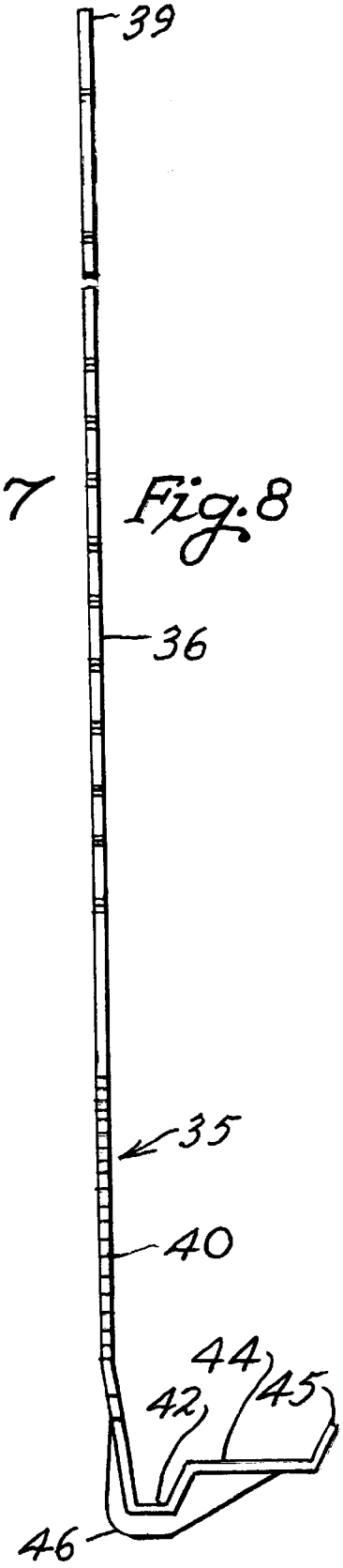
FIG. 8 is a right side view of the shackle of the invention.

The seal 20 further includes a shackle 35 having an elongated strap 36 integrally formed with a base portion 38. The strap has an outer pointed end 39 and is provided with a plurality of outwardly and declined locking teeth 40 which extend outwardly from each of the sides of the strap 36, as shown in FIG. 7. The base 38 of the shackle is shown as including a somewhat V-shaped trough portion 42 and a horizontal shelf portion 44 with an outer upwardly extending flange 45 extending from the shelf 44. The configuration of the upper surface of the base is such that the trough 42 may cooperatively seat against a container frame having a configuration as shown in FIG. 2, whereas the shelf portion 44 is specifically designed to allow the base to be cooperatively seated against a frame having a configuration as shown in FIG. 5. In either case, the flange 45 prevents any manipulation to withdraw the base of the shackle outwardly between the door "D" and the frame "F" of the container. The base is further reinforced by a vertical flange 46 which extends along the shelf and trough portion thereof, such that the base of the shackle cannot bend if force is applied along the strap 36 in an effort to lift the strap from the seated relationship between the door "D" of the container and the frame "F", as shown in FIGS. 2 and 5.

The width of the strap 36 is such that it is cooperatively received within the opening 28 and the recess area defined along the flange 24 of the housing 22.

Figure 1:
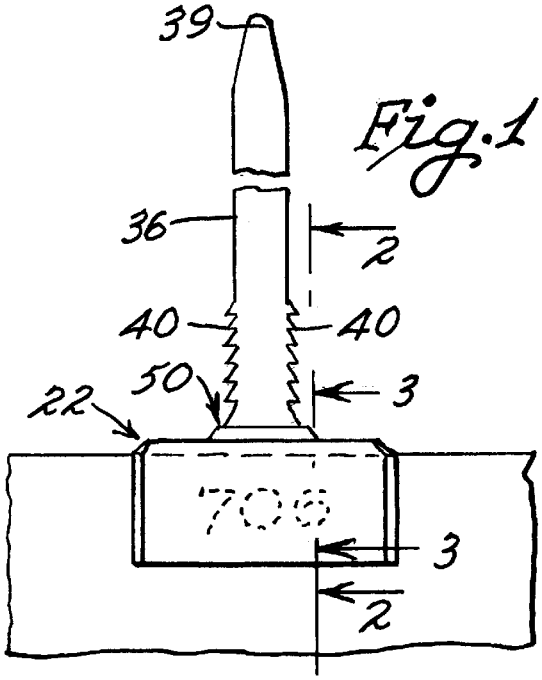
FIG. 1 is a partial front illustrational view showing an embodiment of the invention mounted to an airborne shipping container.
Figure 3:
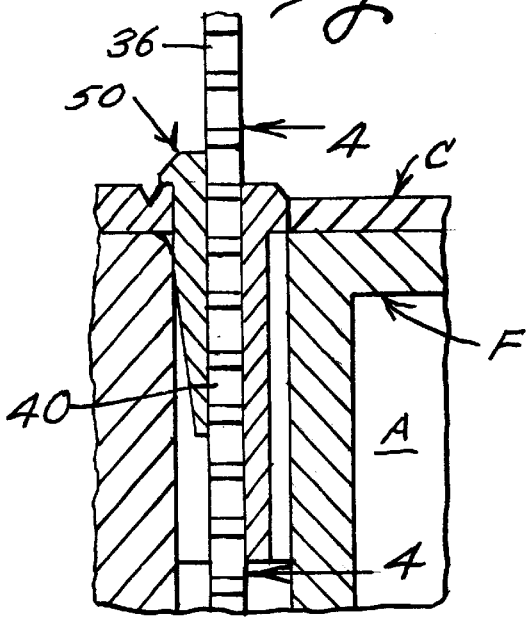
FIG. 3 is an enlarged partial cross sectional view taken along line 3—3 of FIG. 1.

To bind the shackle 35 with respect to the housing 22 and to further bind the seal 20 to the frame "F" of the container, the tamper indicating seal of the present invention includes a third component in the form of a locking cage 50 as shown in FIGS. 13–15. The locking cage includes opposing legs 51 and 52 each having inner and upwardly inclined locking teeth 53 and 54 which are cooperatively engageable with the teeth 40 extending from opposite sides of the strap 36 of the shackle. The legs 51 and 52 are therefore spaced at a distance substantially equal to the width "W" of the strap as shown in FIG. 7 and also in FIG. 13. The cage also includes a spaced central leg 56 which is disposed in a somewhat U-shaped orientation as shown in FIG. 13 with respect to the opposing legs 51 and 52. The legs 51, 52 and 56 are connected by a body portion 57 having and upper outwardly extending flange 58. The flange 58 is provided for purposes of abutting the upper portion 25 of the housing 22 adjacent to the line of weakness 26, as shown in FIG. 3*a,* when the locking cage 50 is seated within the opening 28 in the housing so as to interlock with the shackle strap 36 as shown in FIG. 4.

Figure 4:
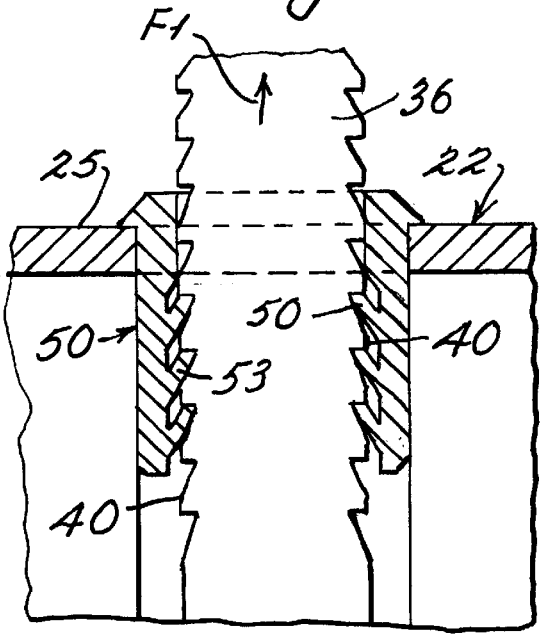
FIG. 4 is an enlarged partial cross sectional view taken along line 4—4 of FIG. 3.

With specific reference to FIG. 4, it should be noted that the shackle strap 36 may be vertically adjusted relative to the locking cage 50 and thus to the housing 22 by providing an upward force as indicated by the arrow "$F_1$" in the drawing figure. The orientation of the locking teeth 40 and the teeth 53 and 54 of the locking cage 50 are such that the shackle can be pulled outwardly of the cage 50 but cannot be pushed inwardly with respect to the locking cage 50 because the locking teeth will not permit such a reverse movement.

Figure 16:
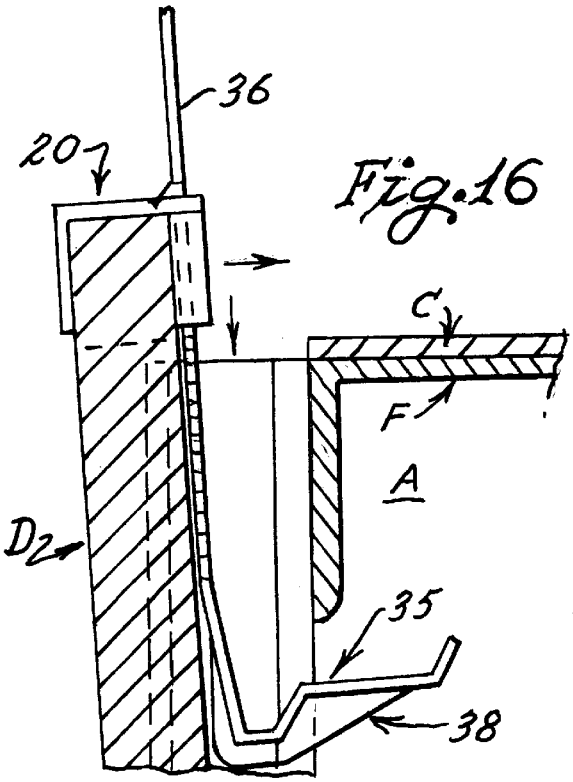
FIG. 16 is a partial cross sectional illustrational view of the embodiment of FIGS. 1–4 mounted to a door being closed relative to a container.
Figure 17:
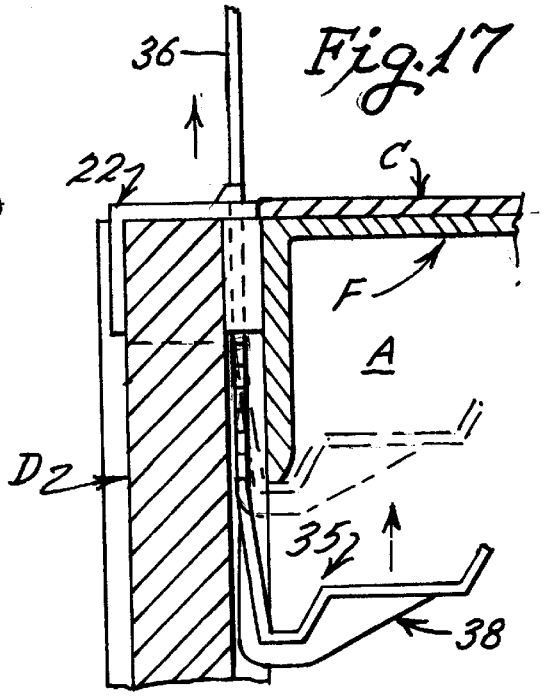
FIG. 17 is a view similar to FIG. 16 showing the seal strap being pulled to securely seat the seal between the container and door.
Figure 18:
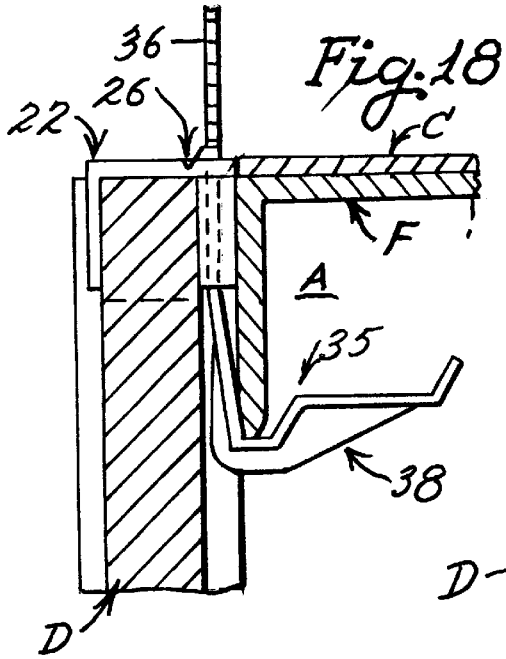
FIG. 18 shows the seal of FIGS. 16 and 17 in finally locked position.
Figure 19:
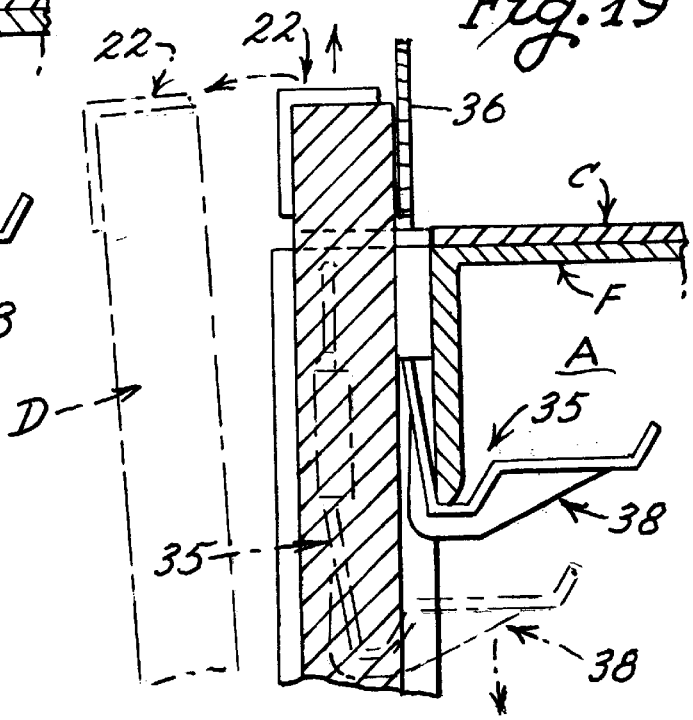
FIG. 19 illustrates the manner in which the seal is destroyed when the door is opened relative to the container.

In use of the seal, the housing 22 is initially seated on an edge of the door "D" and the shackle 35 is secured thereto by extending the strap 36 through the recess and opening 28 and also placing the locking cage 50 in the opening 28 to interlock with the strap, see FIG. 16. Subsequently, the door is closed to the position shown in FIG. 17. Thereafter the strap is pulled outwardly as shown by arrow $F_1$ to interlock the seal components and tightly seat the seal to the door and container frame. With the seal in place as shown in FIG. 18, any attempt to open the door will cause the housing to fracture along the line of weakness 26, thereby giving a visual indication of tampering, as shown in FIG. 19. As shown, the housing has broken free of the shackle and locking cage.

For control purposes, the housing is also provided with numbers, letters or other indicia 60 which are provided on the outer wall or flange 23 thereof.

The seal is preferably formed of plastic materials with at least the housing being formed of a material which will readily fracture, such as a polycarbonate plastic.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A tamper indicating seal for a container having a closure adapted to be movable with respect to an opening in the container and wherein the container has internal frame members, the seal including a housing having a central portion adapted to be seated on an edge of the closure of the container and depending flanges which are spaced from one another a first of which is adapted to engage an outer surface of the closure and a second of which is adapted to be seated intermediate an inner surface of the closure and the container, an opening in said central portion of said housing adjacent said second depending flange, a separate shackle including a strap member and a base portion, said base portion extending transversely with respect to said strap member, said strap member including locking teeth extending outwardly along a portion of a length thereof, said strap member being of a size to be inserted through said opening in said central portion of said housing, a separate locking cage member having a leg portion of a size to be inserted within said opening in said central portion of said housing and an enlarged portion of a size to prohibit passage of said locking cage member through said opening in said central portion of said housing, said leg portion including locking teeth for cooperatively engaging said locking teeth of said strap member and being configured so that said strap member may be pulled in a first direction through said opening in said housing but is prevented from a reverse movement as said strap member is interlocked with said locking cage member, whereby the closure cannot be opened relative to the inner frame member of the container without severing said housing.

2. The tamper indicating seal of claim 1 in which said base portion of said shackle includes a first trough portion adapted to engage an edge of the inner frame member of the container.

3. The tamper indicating seal of claim 2 including a reinforcing flange extending along said base portion for preventing pivoting movement of said base portion relative to an adjacent portion of said strap member.

4. The tamper indicating seal of claim 1 in which said base portion of said shackle includes a shelf portion extending generally perpendicular with respect to said strap member which is adapted to engage the inner frame member of the container, and a flange extending transversely with respect to said shelf portion to prevent lateral movement of said shelf portion when said base portion is engaged with the inner frame member of the container.

5. The tamper indicating seal of claim 4 including a reinforcing flange extending along said base portion for preventing pivoting movement of said base portion relative to an adjacent portion of said strap member.

6. The tamper indicating seal of claim 1 in which said locking teeth of said strap member extend outwardly on opposite side edges thereof and said leg portion of said locking cage member includes a pair of spaced and opposing legs each having locking teeth for cooperatively engaging the locking teeth on opposite side edges of said strap member.

7. The tamper indicating seal of claim 6 in which said enlarged portion of said locking cage member includes a flange for engaging said central portion of said housing adjacent to an area of weakness formed in said central portion of said housing.

8. The tamper indicating seal of claim 7 in which said locking cage member includes a central leg extending intermediate said opposing legs, said central leg being adapted to be seated within said opening in said central portion of said housing in generally abutting relationship with said strap member when said strap member is inserted through said opening in said central portion of said housing.

9. The tamper indicating seal of claim 1 in which said first dependent flange of said housing includes indicia for control purposes.

10. The tamper indicating seal of claim 1 in which said enlarged portion of said locking cage member includes a flange for engaging said central portion of said housing adjacent to an area of weakness formed in said central portion of said housing.

11. A method of sealing a container having a closure movable with respect to an access opening into the container and wherein a frame is provided within the container proximate to the opening utilizing a three-part seal wherein a first part of the seal is adapted to be engaged over an edge portion of the closure and includes an opening therethrough, a second part of the seal is adapted to be engaged within the container to the frame and includes a strap adapted to extend outwardly of the container between the access opening and the closure, and a third part of the seal is adapted to interlock the first and second parts, the method comprising the steps of:

a. mounting the first part of the seal over the edge portion of the door such that the opening in the first part is in communication with the access opening into the container when closure is closed with respect to the access opening, b. positioning the second part of the seal so as to be within the container when the closure is closed relative to the access opening and extending the strap of the second part through the opening in the first component so that when the closure is closed with respect to the access opening into the container, a portion of the strap extends outwardly relative to the access opening between the closure and the container, c. inserting the third part of the seal between the first and second parts within the opening in the first part to assemble the second and third parts to the first part, and d. thereafter pulling the strap of the second part outwardly relative to the closure and the container such that said second part securely engages, within the container, with the frame of the container.

12. The method of claim 11 including the additional step of breaking the first part of the seal by opening of the closure relative to the container to thereby give a positive indication of tampering.

13. A tamper indicating seal for use on doors moveable from a first closed position blocking an access opening to a container to a second open position to permit access to the container through the access opening, the seal including a first generally inverted u-shaped housing having spaced flanges, an opening through said housing adjacent one of said flanges, an area of weakness formed in said housing adjacent said opening, a shackle having a base portion from which extends a strap having a plurality of locking teeth extending outwardly along a portion of a length thereof, said strap being of a size to be moveable within said opening in said housing and said base portion extending transversely to and outwardly from said strap, and a locking member having a leg portion of a size to be inserted within said opening in said housing between said housing and said strap of said shackle when said strap is extended through said opening in said housing, said leg portion of said locking member in cluding teeth engaging with said teeth of said strap, and said locking member including another portion for engaging an area of said housing spaced outwardly of said opening when said locking member is seated within said opening.

* * * * *